US007448986B1

(12) United States Patent
Porth

(10) Patent No.: US 7,448,986 B1
(45) **Date of Patent: *Nov. 11, 2008**

(54) EXERCISE EQUIPMENT WITH AUTOMATIC ADJUSTMENT OF STRIDE LENGTH AND/OR STRIDE HEIGHT BASED UPON THE HEART RATE OF A PERSON EXERCISING ON THE EXERCISE EQUIPMENT

(75) Inventor: Timothy J. Porth, Bloomington, MN (US)

(73) Assignee: Octane Fitness, LLC, Brooklyn Park, MN (US)

( * ) Notice: Subject to any disclaimer, the term of this patent is extended or adjusted under 35 U.S.C. 154(b) by 771 days.

This patent is subject to a terminal disclaimer.

(21) Appl. No.: 10/781,038

(22) Filed: Feb. 18, 2004

(51) Int. Cl.
*A63B 22/04* (2006.01)
*A63B 22/06* (2006.01)

(52) U.S. Cl. ..... 482/52; 482/57

(58) Field of Classification Search ..... 482/51, 482/52, 53, 57, 70, 79–80
See application file for complete search history.

(56) References Cited

U.S. PATENT DOCUMENTS

| | | | |
|---|---|---|---|
| 2,603,486 | A | 7/1952 | Hughes |
| 3,316,898 | A | 5/1967 | Brown |
| 4,509,742 | A | 4/1985 | Cones |
| 4,679,786 | A | 7/1987 | Rodgers, Jr. |
| 4,842,274 | A | 6/1989 | Oosthuizen |
| 4,900,013 | A | 2/1990 | Rodgers, Jr. |
| 5,242,343 | A | 9/1993 | Miller |
| 5,290,211 | A | 3/1994 | Stearns |
| 5,352,169 | A | 10/1994 | Eschenbach |
| 5,365,934 | A | 11/1994 | Leon et al. |
| 5,383,826 | A | 1/1995 | Michael |
| 5,383,829 | A | 1/1995 | Miller |
| 5,401,226 | A | 3/1995 | Stearns |
| 5,423,729 | A | 6/1995 | Eschenbach |
| 5,454,770 | A | 10/1995 | Stevens |
| 5,462,504 | A | 10/1995 | Trulaske et al. |
| 5,518,473 | A | 5/1996 | Miller |
| 5,527,239 | A | 6/1996 | Abbondanza |
| 5,527,246 | A | 6/1996 | Rodgers, Jr. |
| 5,529,554 | A | 6/1996 | Eschenbach |
| 5,529,555 | A | 6/1996 | Rodgers, Jr. |
| 5,540,637 | A | 7/1996 | Rodgers, Jr. |
| 5,549,526 | A | 8/1996 | Rodgers, Jr. |
| 5,562,574 | A | 10/1996 | Miller |
| 5,573,480 | A | 11/1996 | Rodgers, Jr. |
| 5,577,985 | A | 11/1996 | Miller |
| 5,591,107 | A | 1/1997 | Rodgers, Jr. |

(Continued)

FOREIGN PATENT DOCUMENTS

| | | |
|---|---|---|
| DE | 2919494 | 11/1980 |

(Continued)

*Primary Examiner*—Steve R Crow
(74) *Attorney, Agent, or Firm*—Sherrill Law Offices, PLLC

(57) ABSTRACT

The invention is an exercise device comprising (i) a frame, (ii) first and second foot supports operably associated with the frame for traveling along a closed loop path relative to a transverse axis defined by the frame, (iii) a heart rate monitor, and (iv) a means for automatically adjusting the stride length and/or stride height of the closed loop path traveled by the foot supports based upon the sensed heart rate of person exercising on the exercise device.

22 Claims, 11 Drawing Sheets

U.S. PATENT DOCUMENTS

| | | | |
|---|---|---|---|
| 5,593,371 | A | 1/1997 | Rodgers, Jr. |
| 5,593,372 | A | 1/1997 | Rodgers, Jr. |
| 5,595,553 | A | 1/1997 | Rodgers, Jr. |
| 5,598,849 | A | 2/1997 | Browne |
| 5,611,756 | A | 3/1997 | Miller |
| 5,611,757 | A | 3/1997 | Rodgers, Jr. |
| 5,611,758 | A | 3/1997 | Rodgers, Jr. |
| 5,618,245 | A | 4/1997 | Trulaske et al. |
| 5,637,058 | A | 6/1997 | Rodgers, Jr. |
| 5,653,662 | A | 8/1997 | Rodgers, Jr. |
| 5,683,333 | A | 11/1997 | Rodgers, Jr. |
| 5,685,804 | A | 11/1997 | Whan Tong et al. |
| 5,690,589 | A | 11/1997 | Rodgers, Jr. |
| 5,692,994 | A | 12/1997 | Eschenbach |
| 5,707,321 | A | 1/1998 | Maresh |
| 5,725,457 | A | 3/1998 | Maresh |
| 5,735,774 | A | 4/1998 | Maresh |
| 5,738,104 | A | 4/1998 | Lo et al. |
| 5,738,614 | A | 4/1998 | Rodgers, Jr. |
| 5,743,834 | A | 4/1998 | Rodgers, Jr. |
| 5,755,642 | A | 5/1998 | Miller |
| 5,766,113 | A | 6/1998 | Rodgers, Jr. |
| 5,772,558 | A | 6/1998 | Rodgers, Jr. |
| 5,788,609 | A | 8/1998 | Miller |
| 5,788,610 | A | 8/1998 | Eschenbach |
| 5,792,026 | A | 8/1998 | Maresh et al. |
| 5,803,870 | A | 9/1998 | Buhler |
| 5,803,871 | A | 9/1998 | Stearns et al. |
| 5,807,267 | A | 9/1998 | Bryars et al. |
| 5,813,949 | A | 9/1998 | Rodgers, Jr. |
| 5,836,854 | A | 11/1998 | Kuo |
| 5,836,855 | A | 11/1998 | Eschenbach |
| 5,846,166 | A | 12/1998 | Kuo |
| 5,848,954 | A | 12/1998 | Stearns et al. |
| 5,853,351 | A | 12/1998 | Maruo et al. |
| 5,857,941 | A | 1/1999 | Maresh et al. |
| 5,876,307 | A | 3/1999 | Stearns et al. |
| 5,876,308 | A | 3/1999 | Jarvie |
| 5,879,271 | A | 3/1999 | Stearns et al. |
| 5,882,281 | A | 3/1999 | Stearns et al. |
| 5,893,820 | A | 4/1999 | Maresh |
| 5,895,339 | A | 4/1999 | Maresh |
| 5,897,463 | A | 4/1999 | Maresh |
| 5,904,637 | A | 5/1999 | Kuo |
| 5,910,072 | A | 6/1999 | Rawls et al. |
| 5,911,649 | A | 6/1999 | Miller |
| 5,916,064 | A | 6/1999 | Eschenbach |
| 5,919,118 | A | 7/1999 | Stearns et al. |
| 5,921,894 | A | 7/1999 | Eschenbach |
| 5,924,962 | A | 7/1999 | Rodgers, Jr. |
| 5,924,963 | A | 7/1999 | Maresh et al. |
| 5,935,046 | A | 8/1999 | Maresh |
| 5,938,567 | A | 8/1999 | Rodgers, Jr. |
| 5,938,568 | A | 8/1999 | Maresh et al. |
| 5,938,570 | A | 8/1999 | Maresh |
| 5,947,872 | A | 9/1999 | Ryan et al. |
| 5,957,814 | A | 9/1999 | Eschenbach |
| 5,989,163 | A | 11/1999 | Rodgers, Jr. |
| 5,993,359 | A | 11/1999 | Eschenbach |
| 5,997,445 | A | 12/1999 | Maresh et al. |
| 6,024,676 | A | 2/2000 | Eschenbach |
| 6,027,430 | A | 2/2000 | Stearns et al. |
| 6,027,431 | A | 2/2000 | Stearns et al. |
| 6,030,320 | A | 2/2000 | Stearns et al. |
| 6,033,344 | A | 3/2000 | Trulaske et al. |
| 6,042,512 | A | 3/2000 | Eschenbach |
| 6,045,487 | A | 4/2000 | Miller |
| 6,045,488 | A | 4/2000 | Eschenbach |
| 6,053,847 | A | 4/2000 | Stearns et al. |
| 6,063,009 | A | 5/2000 | Stearns et al. |
| 6,077,196 | A | 6/2000 | Eschenbach |
| 6,077,197 | A | 6/2000 | Stearns et al. |
| 6,077,198 | A | 6/2000 | Eschenbach |
| 6,080,086 | A | 6/2000 | Maresh et al. |
| 6,083,143 | A | 7/2000 | Maresh |
| 6,090,013 | A | 7/2000 | Eschenbach |
| 6,090,014 | A | 7/2000 | Eschenbach |
| 6,099,439 | A | 8/2000 | Ryan et al. |
| 6,113,518 | A | 9/2000 | Maresh et al. |
| 6,123,650 | A | 9/2000 | Birrell |
| 6,126,574 | A | 10/2000 | Stearns et al. |
| 6,135,923 | A | 10/2000 | Stearns et al. |
| 6,142,915 | A | 11/2000 | Eschenbach |
| 6,146,313 | A | 11/2000 | Whan Tong et al. |
| 6,152,859 | A | 11/2000 | Stearns |
| 6,163,718 | A | 12/2000 | Fabrizio |
| 6,165,107 | A | 12/2000 | Birrell |
| 6,165,129 | A | 12/2000 | Bates |
| 6,168,552 | B1 | 1/2001 | Eschenbach |
| 6,171,215 | B1 | 1/2001 | Stearns et al. |
| 6,171,217 | B1 | 1/2001 | Cutler |
| 6,176,814 | B1 | 1/2001 | Ryan et al. |
| 6,183,397 | B1 | 2/2001 | Stearns et al. |
| 6,183,398 | B1 | 2/2001 | Rufino et al. |
| 6,190,289 | B1 | 2/2001 | Pyles et al. |
| 6,196,948 | B1 | 3/2001 | Stearns et al. |
| 6,206,804 | B1 | 3/2001 | Maresh |
| 6,210,305 | B1 | 4/2001 | Eschenbach |
| 6,217,485 | B1 | 4/2001 | Maresh |
| 6,248,044 | B1 | 6/2001 | Stearns et al. |
| 6,248,045 | B1 | 6/2001 | Stearns et al. |
| 6,248,046 | B1 | 6/2001 | Maresh et al. |
| 6,254,514 | B1 | 7/2001 | Maersh et al. |
| 6,277,054 | B1 | 8/2001 | Kuo |
| 6,283,895 | B1 | 9/2001 | Stearns et al. |
| 6,302,825 | B1 | 10/2001 | Stearns et al. |
| 6,302,830 | B1 | 10/2001 | Stearns |
| 6,304,774 | B1 | 10/2001 | Gorman |
| 6,312,362 | B1 | 11/2001 | Maresh et al. |
| 6,338,698 | B1 | 1/2002 | Stearns et al. |
| 6,340,340 | B1 | 1/2002 | Stearns et al. |
| 6,361,476 | B1 | 3/2002 | Eschenbach |
| 6,368,252 | B1 | 4/2002 | Stearns |
| 6,387,017 | B1 | 5/2002 | Maresh |
| 6,390,953 | B1 | 5/2002 | Maresh et al. |
| 6,398,695 | B2 | 6/2002 | Miller |
| 6,409,632 | B1 | 6/2002 | Eschenbach |
| 6,409,635 | B1 | 6/2002 | Maresh et al. |
| 6,416,442 | B1 | 7/2002 | Stearns et al. |
| 6,422,976 | B1 | 7/2002 | Eschenbach |
| 6,422,977 | B1 | 7/2002 | Eschenbach |
| 6,436,007 | B1 | 8/2002 | Eschenbach |
| 6,440,042 | B2 | 8/2002 | Eschenbach |
| 6,450,922 | B1 | 9/2002 | Henderson et al. |
| 6,450,925 | B1 | 9/2002 | Kuo |
| 6,454,682 | B1 | 9/2002 | Kuo |
| 6,461,277 | B2 | 10/2002 | Maresh et al. |
| 6,482,130 | B1 | 11/2002 | Pasero et al. |
| 6,482,132 | B2 | 11/2002 | Eschenbach |
| 6,500,096 | B1 | 12/2002 | Farney |
| 6,512,947 | B2 | 1/2003 | Bartholome |
| 6,527,677 | B2 | 3/2003 | Maresh |
| 6,527,680 | B1 | 3/2003 | Maresh |
| 6,540,646 | B2 | 4/2003 | Stearns et al. |
| 6,544,146 | B1 | 4/2003 | Stearns et al. |
| 6,547,701 | B1 | 4/2003 | Eschenbach |
| 6,551,217 | B2 | 4/2003 | Kaganovsky |
| 6,551,218 | B2 | 4/2003 | Goh |
| 6,554,750 | B2 | 4/2003 | Stearns et al. |
| 6,554,776 | B1 | 4/2003 | Snow et al. |
| 6,565,486 | B2 | 5/2003 | Stearns et al. |
| 6,569,061 | B2 | 5/2003 | Stearns et al. |
| 6,572,511 | B1 | 6/2003 | Volpe |
| 6,575,877 | B2 | 6/2003 | Rufino et al. |

6,579,210 B1 6/2003 Stearns et al.
6,584,344 B2 6/2003 Hannula
6,605,044 B2 8/2003 Bimbaum
6,612,969 B2 9/2003 Eschenbach
6,620,079 B2 9/2003 Kuo
6,626,800 B1 9/2003 Casler
6,626,802 B1 9/2003 Rodgers, Jr.
6,629,909 B1 10/2003 Stearns et al.
6,634,992 B1 10/2003 Ogawa
6,648,798 B2 11/2003 Yoo
6,719,665 B1 4/2004 Lai
6,726,600 B2 4/2004 Miller
6,733,419 B2 5/2004 Liu
6,749,540 B1 6/2004 Pasero
6,752,744 B2 6/2004 Arnold
6,783,481 B2 8/2004 Sterns et al.
6,786,851 B1 9/2004 Maresh
6,811,517 B1 11/2004 Eschenbach
6,830,538 B2 12/2004 Eschenbach
6,835,166 B1 12/2004 Stearns et al.
6,837,829 B2 1/2005 Eschenbach
6,846,272 B2 1/2005 Rosenow et al.
6,846,273 B1 1/2005 Stearns et al.
6,849,033 B1 2/2005 Stearns et al.
6,849,034 B2 2/2005 Eschenbach
7,097,591 B2 8/2006 Moon
7,270,626 B2 * 9/2007 Porth ..... 482/52
2001/0004623 A1 6/2001 Miller
2001/0011053 A1 8/2001 Miller
2001/0036886 A1 11/2001 Eschenbach
2001/0051562 A1 12/2001 Stearns et al.
2002/0019298 A1 2/2002 Eschenbach
2002/0055420 A1 5/2002 Stearns et al.
2002/0082146 A1 6/2002 Stearns et al.
2002/0128122 A1 9/2002 Miller
2002/0142890 A1 10/2002 Ohrt et al.
2002/0155927 A1 10/2002 Corbalis et al.
2002/0165006 A1 11/2002 Stearns
2003/0022763 A1 1/2003 Eschenbach
2003/0027690 A1 2/2003 Miler
2003/0047902 A1 3/2003 Miller
2004/0043873 A1 3/2004 Wilkinson
2004/0053748 A1 3/2004 Lo
2004/0077463 A1 4/2004 Rodgers, Jr.
2004/0097339 A1 5/2004 Moon
2004/0097340 A1 5/2004 Liao
2004/0102291 A1 5/2004 Echenbach
2004/0132583 A1 7/2004 Ohrt et al.
2004/0162191 A1 8/2004 Ecranbrack et al.
2004/0209741 A1 10/2004 Kuo
2004/0235621 A1 11/2004 Eschenbach
2004/0235622 A1 11/2004 Eschenbach
2004/0248704 A1 12/2004 Rodgers, Jr.
2004/0248705 A1 12/2004 Rodgers, Jr.
2004/0248706 A1 12/2004 Rodgers, Jr.
2004/0248707 A1 12/2004 Rodgers, Jr.
2004/0248708 A1 12/2004 Rodgers, Jr.
2004/0248709 A1 12/2004 Rodgers, Jr.
2004/0248710 A1 12/2004 Rodgers, Jr.
2004/0248711 A1 12/2004 Rodgers, Jr.
2004/0266587 A1 12/2004 Miller
2004/0266588 A1 12/2004 Miller
2005/0009668 A1 1/2005 Savettiere et al.
2005/0026752 A1 2/2005 Lull et al.
2005/0181911 A1 * 8/2005 Porth ..... 482/52

FOREIGN PATENT DOCUMENTS

WO WO 2004/108223 A1 12/2004
WO WO 2004/108224 A1 12/2004
WO WO 2004/108225 A1 12/2004
WO WO 2005/000421 A2 1/2005

* cited by examiner

EXERCISE EQUIPMENT WITH AUTOMATIC ADJUSTMENT OF STRIDE LENGTH AND/OR STRIDE HEIGHT BASED UPON THE HEART RATE OF A PERSON EXERCISING ON THE EXERCISE EQUIPMENT

FIELD OF THE INVENTION

This invention relates to exercise equipment, more specifically to stationary cardiovascular exercise equipment, and most specifically to elliptical exercise equipment.

BACKGROUND

It is widely accepted that exercising at the right intensity, generally measured by heart rate, is one of the keys to achieving a desired fitness goal. Some heart rate zones are more effective for burning fat, while others are better for improving stamina. A wide variety of monitors are known and commercially available for measuring heart rate while exercising. See, for example, U.S. Pat. Nos. 5,365,934 issued to Leon et al., 5,738,104 issued to Lo et al., 5,807,267 issued to Brayers et al., and 6,163,718 issued to Fabrizio., the disclosures of which are hereby incorporated by reference.

It is a common practice to equip stationary exercise equipment with a heart rate monitor and associated display so that a user is apprised of their heart rate during a workout session and can modify their workout regimen (e.g., change workload by changing resistance or speed) to achieve a desired heart rate during various stages of the workout session. See, for example, U.S. Pat. Nos. 5,527,239 issued to Abbondanza, 5,598,849 issued to Browne, 6,165,129 issued to Bates, 6,512,947 issued to Bartholome, 6,554,776 issued to Snow et al., 6,584,344 issued to Hannula, and 6,626,800 issued to Casler, the disclosures of which are hereby incorporated by reference.

It is also known to equip stationary exercise equipment with a control system capable of monitoring the heart rate of a user and automatically adjusting certain parameters on the exercise equipment during a workout session, based upon a preselected and/or predetermined target, for purposes of modifying the workout regimen to achieve and/or maintain a desired heart rate during various stages of the workout session. See, for example, U.S. Pat. Nos. 5,462,504 issued to Trulaske et al., 5,527,239 issued to Abbondanza, 5,618,245 issued to Trulaske et al., 5,803,870 issued to Buhler, 5,853,181 issued to Maruo et al., 6,033,344 issued to Trulaske et al., 6,304,774 issued to Gorman, 6,450,922 issued to Henderson et al., 6,605,044 issued to Bimbaum, 6,648,798 issued to Yoo, the disclosures of which are hereby incorporated by reference.

One type of stationary cardiovascular exercise equipment which has become extremely popular based predominantly upon its low-impact and natural motion is the elliptical exercise machine. A wide variety of elliptical exercise machines have been developed. Briefly, elliptical exercise machines include foot supports supported upon foot links with the foot links pivotally connected at a first end through a linkage system to a drive shaft for travel along a defined closed loop path (e.g., circular, elliptical, oval, etc.) and connected at the other end for reciprocating motion along a defined path as the first end travels along the closed loop path. This combination of looping and reciprocating paths of travel at opposite ends of the foot links impart an "elliptical" type motion to the foot supports attached to the foot links.

Such elliptical exercise machines permit a user to adjust the location of various connection and/or contact points on the machine to vary the incline of the elliptical motion of the foot supports at the start of a workout session and to exercise at different speeds during the workout session. These features significantly enhance the value of the machine by permitting a user to select the desired level of difficulty for a workout session by adjusting the incline of the elliptical motion of the foot supports, and to exercise at varying speeds during the workout session. However, these machines do not alter the path of travel of the foot supports during a workout session based upon real-time variables.

Accordingly, a need exists for elliptical exercise machines which permit a user to exercise at varying speeds and automatically alters the path of travel of the foot supports during a workout session dependant upon the heart rate of the user.

SUMMARY OF THE INVENTION

A first embodiment of the invention is an exercise device comprising (i) a frame, (ii) first and second foot supports operably associated with the frame for traveling along a closed loop path relative to a transverse axis defined by the frame, (iii) a heart rate monitor, and (iv) a means for automatically adjusting the stride length of the closed loop path traveled by the foot supports based upon the sensed heart rate of a person exercising on the exercise device.

A second embodiment of the invention is an exercise device comprising (i) a frame, (ii) first and second foot supports operably associated with the frame for traveling along a closed loop path relative to a transverse axis defined by the frame, (iii) a heart rate monitor, and (iv) a means for automatically adjusting the stride height of the closed loop path traveled by the foot supports based upon the sensed heart rate of a person exercising on the exercise device.

A third embodiment of the invention is an exercise device comprising (i) a frame, (ii) first and second foot supports operably associated with the frame for traveling along a closed loop path relative to a transverse axis defined by the frame, (iii) a heart rate monitor, and (iv) a means for automatically adjusting the stride length and stride height of the closed loop path traveled by the foot supports based upon the sensed heart rate of a person exercising on the exercise device.

DETAILED DESCRIPTION OF THE INVENTION INCLUDING A BEST MODE

Nomenclature

Figure 1:
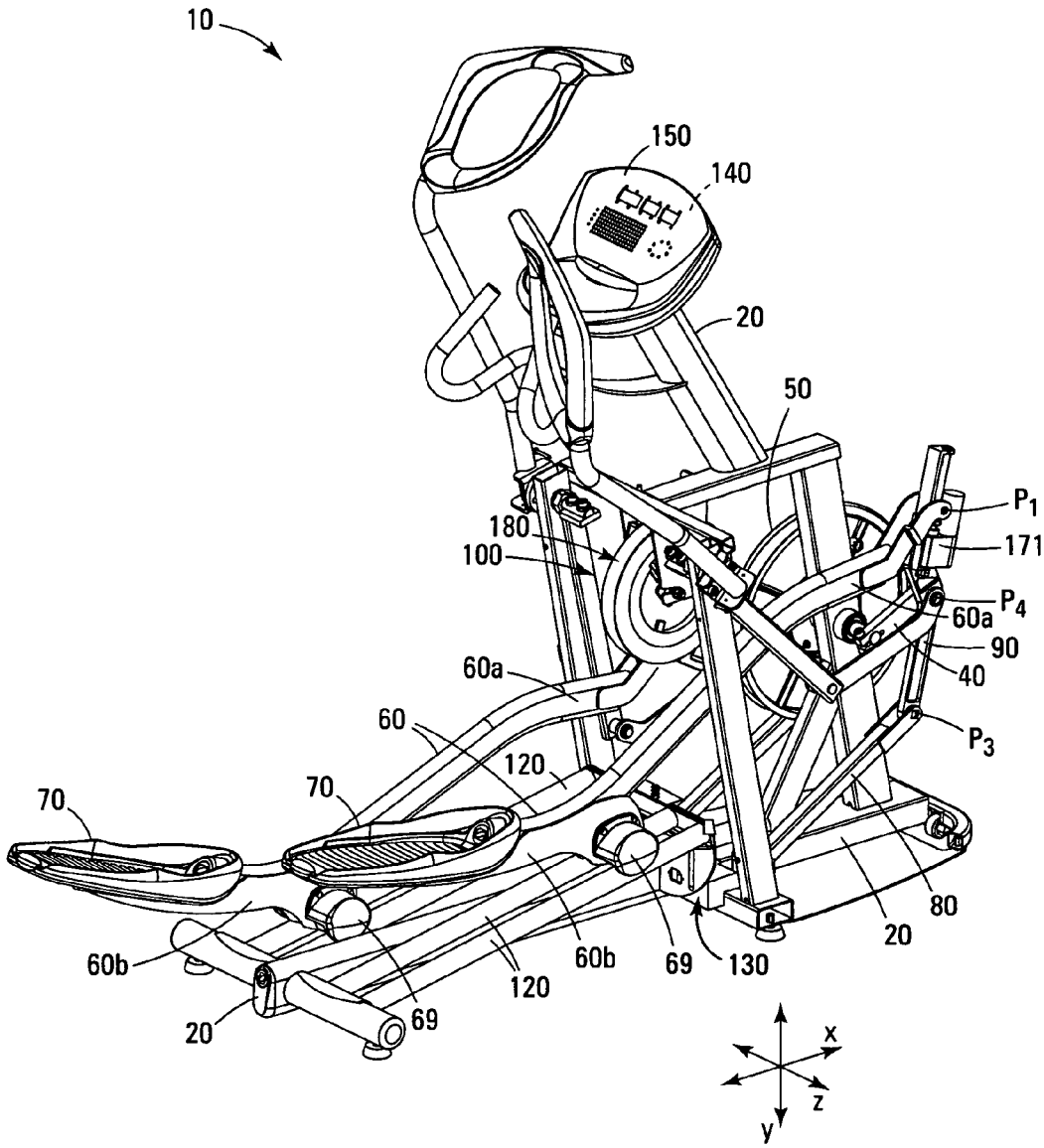
FIG. 1 is a perspective view of one embodiment of the invention.

10 Exercise Device
20 Frame
21 Front Stanchion Portion of Frame
22 Rear Stanchion Portion of Frame
30 Drive Shaft
40 Crank Arm
40*a* First End of Crank Arm
40*b* Second End of Crank Arm
50 Drive Pulley
50*a* Front Drive Pulley
50*b* Rear Drive Pulley
60 Foot Link
60*a* First End of Foot Link
60*b* Second End of Foot Link
61*p* Closed Loop Path of Travel for One End Portion of Foot Link
62*p* Path of Travel for Other End Portion of Foot Link
69 Roller on Foot Link
70 Foot Support
70*p* Closed Loop Path of Travel for Foot Support
80 Rocker Link
80*a* First End of Rocker Link
80*b* Second End of Rocker Link
90 Connector Link
90*a* First End of Connector Link
90*b* Second End of Connector Link
100 Brake
110 Braking Control System
120 Guide Rail
121 Rear Guide Arm
121*a* First End of Rear Guide Arm
121*b* Second End of Rear Guide Arm
130 Incline Adjustment System
140 Master Control Unit
150 User Interface Panel
160 Heart Rate Monitor
171 First Pivot Point Repositioning Unit
172 Pivot Point Repositioning Unit
173 Pivot Point Repositioning Unit
174 Pivot Point Repositioning Unit
180 Inertia Generation System
181 Flywheel
182 Pulley (small diameter)
183 Shaft
184 Drive Belt
221 Front Guide Arm
221*a* First End of Front Guide Arm
221*b* Second End of Front Guide Arm
230 Linear Actuator
310 Support Shaft
320 Rocker Link
320*a* First End of Rocker Link
320*b* Second End of Rocker Link
330 Drawbar
330*a* First End of Drawbar
330*b* Second End of Drawbar
340 Timing Belt
$p_1$ First End Foot Link Pivot Point
$p_2$ Second End Foot Link Pivot Point
$p_3$ Rocker Pivot Point
$p_4$ Crank Pivot Point
$p_5$ Front Guide Arm Pivot Point
$p_6$ Rear Guide Arm Pivot Point
$p_7$ Rocker-Foot Pad Pivot Point
$p_8$ Rocker-Frame Pivot Point
$p_9$ Drawbar-Rocker Pivot Point
A Person
SH Stride Height
SL Stride Length
x Lateral Axis
$x_1$ First Lateral Direction
$x_2$ Second Lateral Direction
y Longitudinal Axis
z Transverse Axis
$z_1$ First Transverse Axis
$z_2$ Second Transverse Axis

DEFINITIONS

As utilized herein, including the claims, the phrase "extension element" includes any component attached to and extending substantially orthogonally from a drive shaft by which circular motion is imparted to the drive shaft. Exemplary extension elements include specifically, but not exclusively, a bent portion of a drive shaft, a crank arm, a drive pulley, and rigidly or pivotally attached combinations thereof.

As utilized herein, including the claims, the phrase "stride height" means the vertical distance between highest and lowest vertical points along the path traveled by a foot support.

As utilized herein, including the claims, the phrase "stride length" means the linear distance between forward most and rearward most points along the path traveled by a foot support.

Construction

As shown in FIGS. 1-11, the invention is an exercise device 10 including at least (i) a frame 20 defining a transverse axis z, (ii) first and second foot supports 70 operably associated with the frame 20 for traveling along a closed loop path 70*p* relative to the transverse axis z wherein the closed loop path 70*p* defines a stride length SL and stride height SH, (iii) a heart rate monitor 160 effective for sensing the heart rate of a person A exercising on the exercise device 10, and (iv) a means (not collectively numbered) for automatically adjusting the stride length SL and/or the stride height SH of the closed loop path 70*p* traveled by the foot supports 70 based upon the sensed heart rate of a person A exercising on the exercise device 10.

As shown in FIGS. 1, 2, 6, 9 and 10 the frame 20 includes a base (not separately numbered) for stably supporting the exercise device 10 on a floor (not shown), and a plurality of stiles, rails, stanchions and other supporting members (not separately numbered) as necessary and appropriate to operably support the components of the exercise device 10.

As shown in FIGS. 2, 3, 6, 8, 10 and 11, a drive shaft 30 is supported by the frame 20 for rotation about a transverse axis z. An extension element(s) (not collectively numbered) is rigidly attached to the drive shaft 30 and extends substantially orthogonally from the drive shaft 30. A variety of suitable extension element(s) are known to those skilled in the art, including specifically, but not exclusively, bent end portions (not shown) of the drive shaft 30, a pair of crank arms 40, a drive pulley 50, etc.

Figure 2:
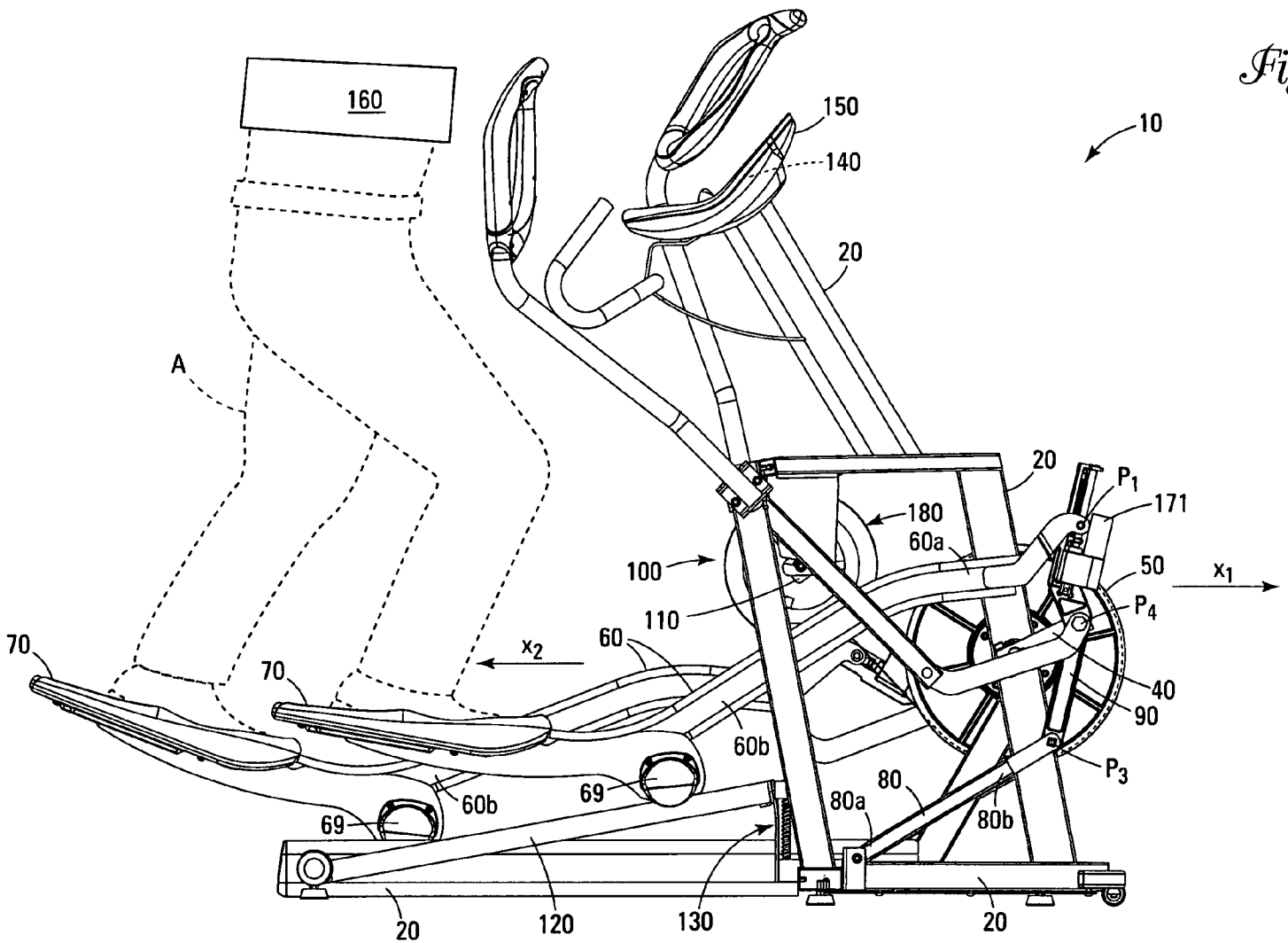
FIG. 2 is a side view of the invention shown in FIG. 1 with the protective housing removed and depicting a single foot link and associated components.
Figure 3:
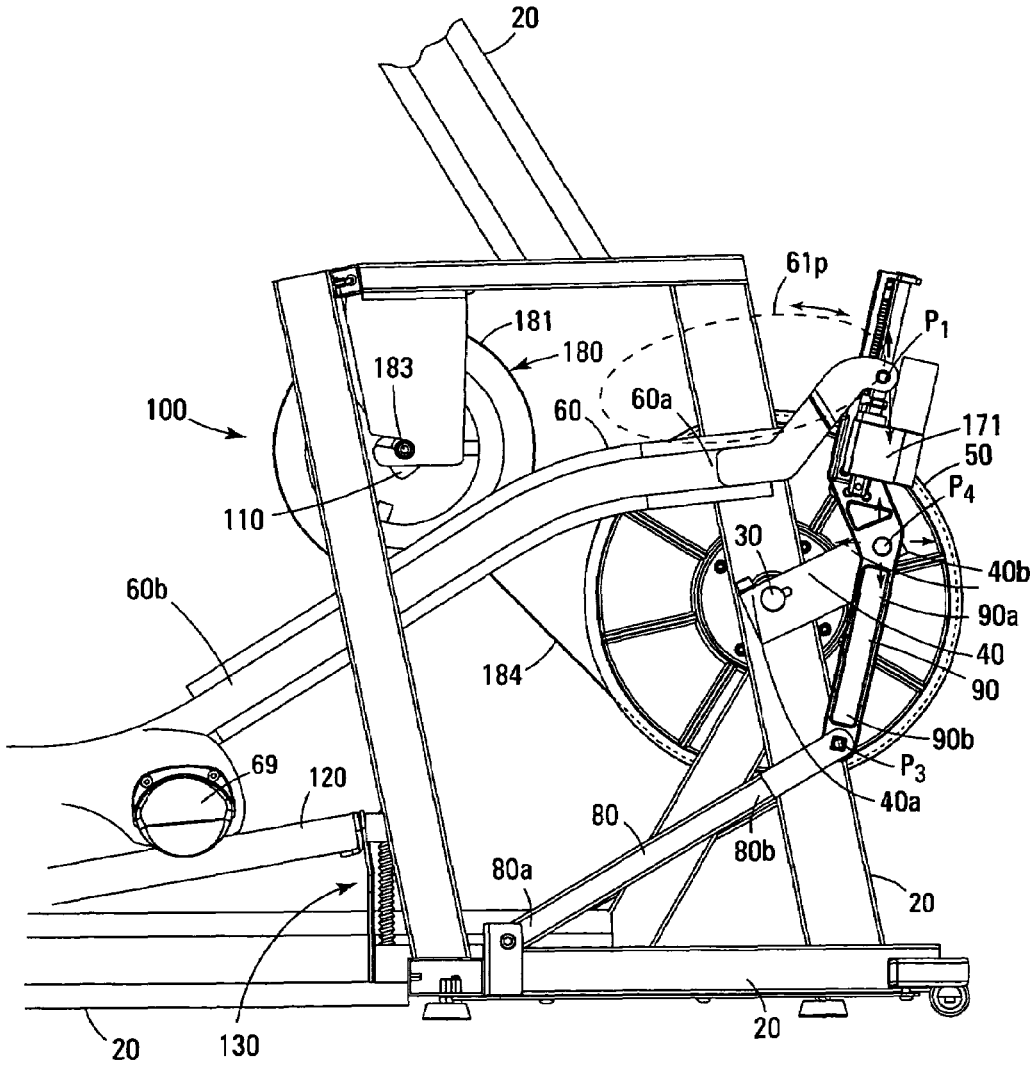
FIG. 3 is an enlarged view of the forward portion of the invention shown in FIG. 2 depicting the first end portion of the foot link and associated dynamic components.
Figure 4:
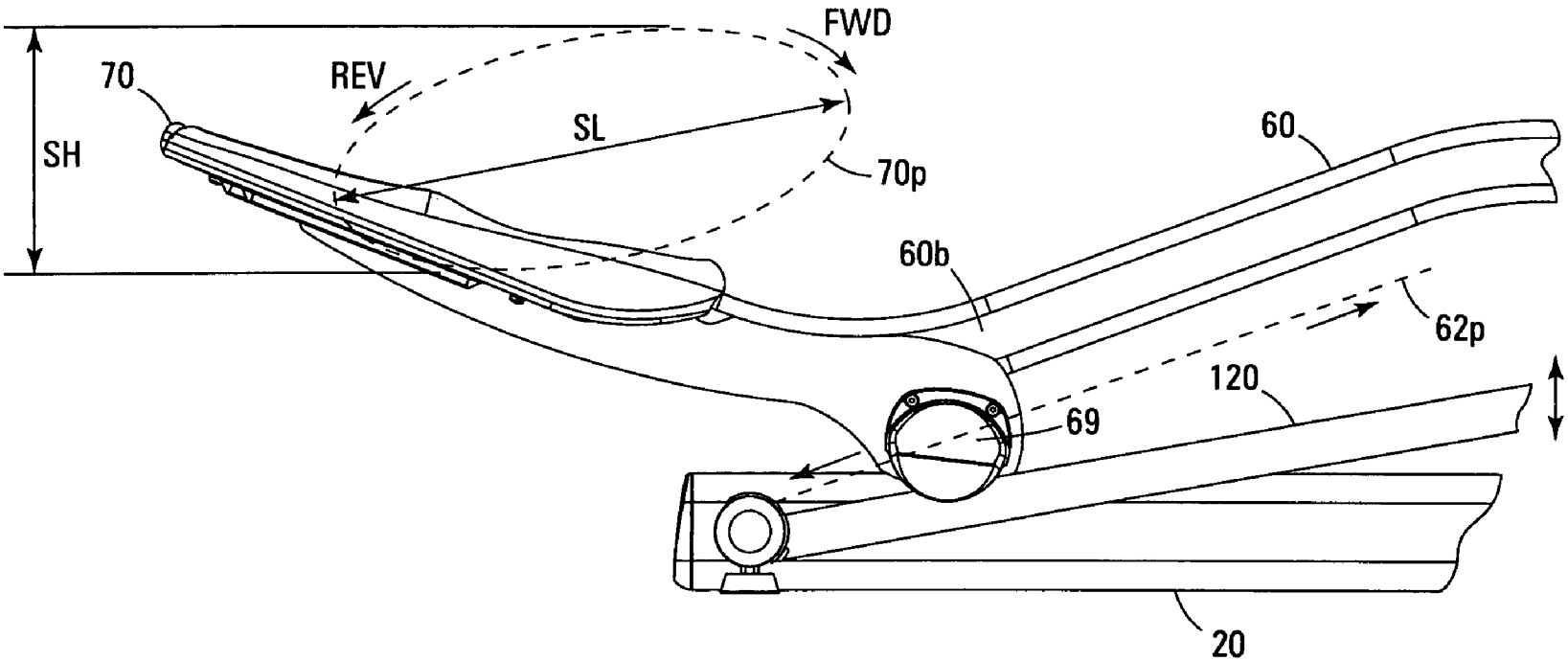
FIG. 4 is an enlarged view of the rearward portion of the invention shown in FIG. 2 depicting the second end portion of the foot link and associated supporting components.

As shown in FIGS. 2 and 3, when the extension elements are crank arms 40 each crank arm 40 has a first end 40*a* rigidly attached proximate a transverse end (not separately numbered) of the drive shaft 30 for imparting rotational motion of the crank arms 40 about the transverse axis z to the drive shaft 30 and interlocking the crank arms 40.

As shown in FIGS. 6, 8, 10 and 11, when the extension element is a drive pulley 50 the drive pulley 50 is rigidly attached the drive shaft 30 at the center (not separately numbered) of the drive pulley 50 for imparting rotational motion of the drive pulley 50 about the transverse axis z to the drive shaft 30.

Foot supports 70 are supported upon first and second foot links 60. The foot supports 70 may be supported upon the foot links 60 at any point along the length (unnumbered) of the foot links 60 so long as the foot link 60 moves in a closed loop path at the point of connection (unnumbered). For example, the embodiment of the invention shown in FIGS. 1-4 laterally positions the foot supports 70 in the second lateral direction $x_2$ from the point (not numbered) at which the foot link 60 is supported by the guide rail 120. The embodiment of the invention shown in FIGS. 6-8 positions the foot supports 70 between the point (unnumbered) at which the foot link 60 is pivotally connected to the crank arm 40 and the point $p_1$ at which the foot link 60 is pivotally connected to the front guide arm 221. The embodiment of the invention shown in FIGS. 9-11 positions the foot supports 70 between the point (unnumbered) at which the foot link 60 is pivotally connected to the front drive pulley 50*a* and the point (unnumbered) at which the foot link 60 is pivotally connected to the rear drive pulley 50*b*. Other embodiments are also possible.

The first and second foot links 60 may be associated with the frame 20 in a variety of different ways to accomplish and impart the necessary closed loop path of travel to the foot supports 70 attached to the foot links 60. Exemplary connective structures and arrangements are disclosed in U.S. Pat. Nos. 3,316,898 issued to Brown, 5,242,343 issued to Miller, 5,352,169 issued to Eschenbach, 5,383,829 issued to Miller, 5,423,729 issued to Eschenbach, 5,518,473 issued to Miller, 5,529,554 issued to Eschenbach, 5,562,574 issued to Miller, 5,577,985 issued to Miller, 5,611,756 issued to Miller, 5,685,804 issued to Whan-Tong et al., 5,692,994 issued to Eschenbach, 5,707,321 issued to Maresh, 5,725,457 issued to Maresh, 5,735,774 issued to Maresh, 5,755,642 issued to Miller, 5,788,609 issued to Miller, 5,788,610 issued to Eschenbach, 5,792,026 issued to Maresh et al., 5,803,871 issued to Stearns et al., 5,836,854 issued to Kuo, 5,836,855 issued to Eschenbach, 5,846,166 issued to Kuo, 5,848,954 issued to Stearns et al., 5,857,941 issued to Maresh et al., 5,876,307 issued to Stearns et al., 5,876,308 issued to Jarvie, 5,879,271 issued to Stearns et al., 5,882,281 issued to Stearns et al., 5,882,281 issued to Stearns et al., 5,893,820 issued to Maresh et al., 5,895,339 issued to Maresh, 5,897,463 issued to Maresh, 5,911,649 issued to Miller, 5,916,064 issued to Eschenbach, 5,919,118 issued to Stearns et al., 5,921,894 issued to Eschenbach, 5,924,963 issued to Maresh et al., 5,935,046 issued to Maresh, 5,938,568 issued to Maresh et al., 5,938,570 issued to Maresh, 5,947,872 issued to Eschenbach, 5,957,814 issued to Eschenbach, 5,993,359 issued to Eschenbach, 5,997,445 issued to Maresh et al., 6,126,574 issued to Stearns et al., 6,248,044 issued to Stearns et al., 6,024,676 issued to Eschenbach, 6,027,430 issued to Stearns et al., 6,027,431 issued to Stearns et al., 6,030,320 issued to Stearns et al., 6,042,512 issued to Eschenbach, 6,045,487 issued to Miller, 6,045,488 issued to Eschenbach, 6,053,847 issued to Stearns et al., 6,063,009 issued to Stearns et al., 6,077,196 issued to Eschenbach, 6,077,197 issued to Stearns et al., 6,077,198 issued to Eschenbach, 6,080,086 issued to Stearns et al., 6,083,143 issued to Maresh, 6,090,013 issued to Eschenbach, 6,090,014 issued to Eschenbach, 6,099,439 issued to Eschenbach, 6,113,518 issued to Maresh et al., 6,123,650 issued to Birrell, 6,135,923 issued to Stearns et al., 6,142,915 issued to Eschenbach, 6,146,313 issued to Whan-Tong et al., 6,165,107 issued to Birrell, 6,168,552 issued to Eschenbach, 6,171,215 issued to Stearns et al., 6,171,217 issued to Cutler, 6,176,814 issued to Eschenbach, 6,183,397 issued to Stearns et al., 6,183,398 issued to Rufino et al., 6,190,289 issued to Pyles et al., 6,196,948 issued to Stearns et al., 6,206,804 issued to Maresh, 6,210,305 issued to Eschenbach, 6,217,485 issued to Maresh, 6,248,045 issued to Stearns et al., 6,248,046 issued to Maresh et al., 6,254,514 issued to Maresh et al., 6,277,054 issued to Kuo, 6,283,895 issued to Stearns et al., 6,302,825 issued to Stearns et al., 6,312,362 issued to Maresh et al., 6,338,698 issued to Stearns et al., 6,340,340 issued to Stearns et al., 6,361,476 issued to Eschenbach, 6,387,017 issued to Maresh, 6,390,953 issued to Maresh et al., 6,398,695 issued to Miller, 6,409,632 issued to Eschenbach, 6,409,635 issued to Maresh et al., 6,416,442 issued to Stearns et al., 6,422,976 issued to Eschenbach, 6,422,977 issued to Eschenbach, 6,436,007 issued to Eschenbach, 6,440,042 issued to Eschenbach, 6,454,682 issued to Kuo, 6,461,277 issued to Maresh et al., 6,482,130 issued to Pasero et al., 6,482,132 issued to Eschenbach, 6,500,096 issued to Farney, 6,527,677 issued to Maresh, 6,527,680 issued to Maresh, 6,540,646 issued to Stearns et al., 6,544,146 issued to Stearns et al., 6,547,701 issued to Eschenbach, 6,551,217 issued to Kaganovsky, 6,551,218 issued to Goh, 6,554,750 issued to Stearns et al., 6,565,486 issued to Stearns et al., 6,569,061 issued to Stearns et al., 6,575,877 issued to Rufino et al., 6,579,210 issued to Stearns et al., 6,612,969 issued to Eschenbach, 6,629,909 issued to Stearns et al., and United States Patent Application Publication Nos. 2001/0011053 filed by Miller, 2001/0051562 filed by Stearns et al., 2002/0019298 filed by Eschenbach, 2002/0055420 filed by Stearns et al., 2002/0128122 filed by Miller, 2002/0142890 filed by Ohrt et al., 2002/0155927 filed by Corbalis et al., 2003/0022763 filed by Eschenbach, which disclosure is hereby incorporated by reference.

Figure 5:
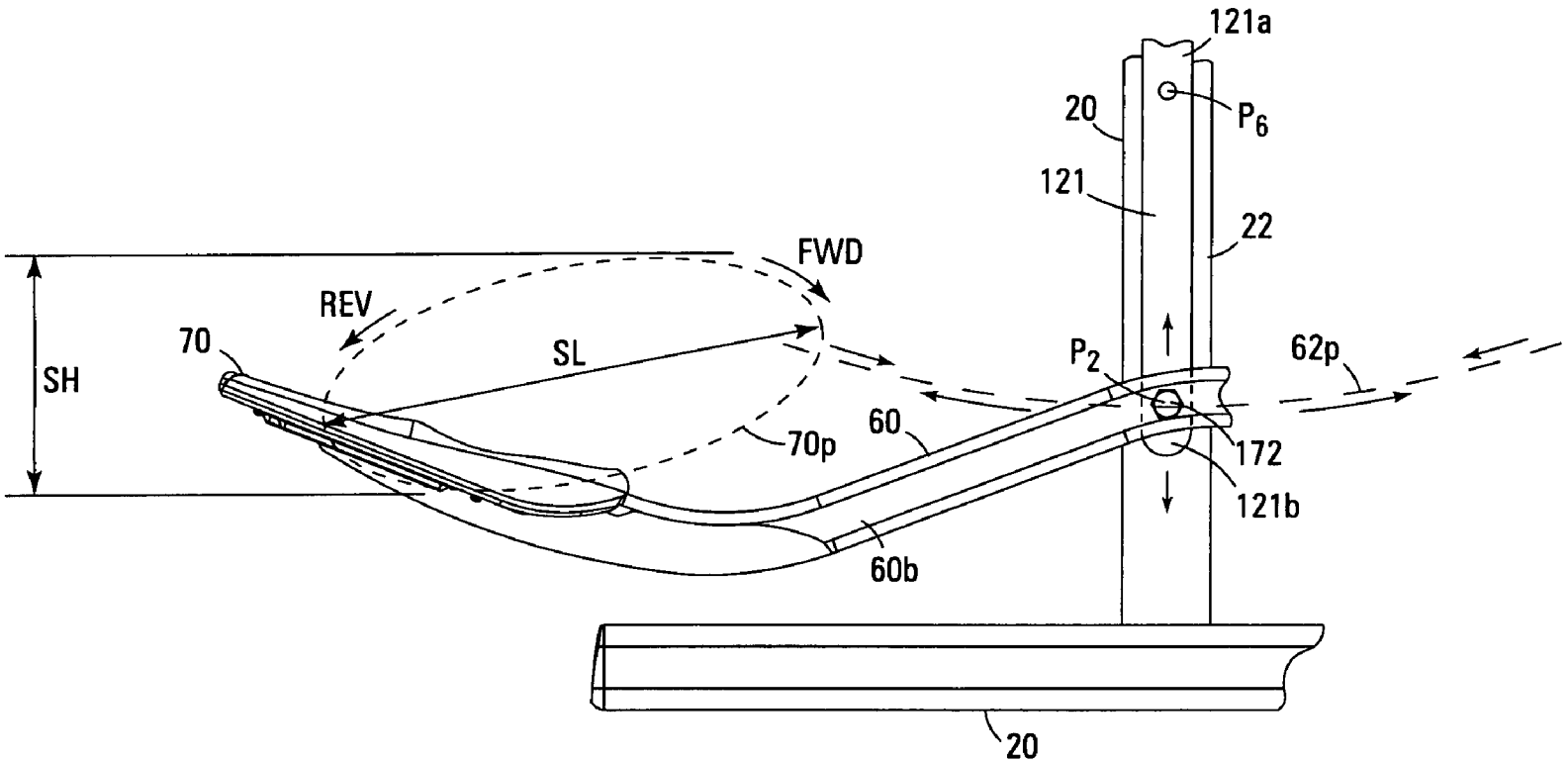
FIG. 5 is a side view of an alternate embodiment of the rear portion of the invention shown in FIG. 2 depicting a single foot link and associated components.

One specific embodiment of a structure for operably interconnecting the first and second foot links 60 with the frame 20 is shown in FIGS. 1-4. This embodiment has (i) a first end portion 60*a* of each foot link 60 indirectly pivotally attached, through a connecting system (not collectively numbered) to the second end 40*b* of a crank arm 40 at a point spaced from the transverse axis z for travel along a closed loop path 61*p* relative to the transverse axis z, and (ii) a second end portion 60*b* of each foot link 60 supported by a roller 69 upon a guide rail 120 for reciprocating travel of the second end portion 60*b* of the foot link 60 along a lateral path 62*p*. An alternate embodiment for supporting the second end portion 60*b* of each foot link 60 to the frame 20 is shown in FIG. 5, wherein the a second end portion 60*b* of each foot link 60 is pivotally attached proximate the second end 121*b* of a rear guide arm 121, which is pivotally attached proximate a first end 121*a* of the rear guide arm 121 to the frame 20 at a rear guide arm pivot point $p_6$ located above the foot link 60, for reciprocating travel of the second end portion 60*b* of the foot link 60 along a lateral path 62*p*.

One suitable connecting system is shown in FIGS. 1-4. The depicted connection system includes (i) a connector link 90 pivotally attached at a first end 90*a* to the first end 60*a* of the foot link 60 at a first end foot link pivot point $p_1$ and pivotally attached at a second end 90*b* to a second end 80*b* of a rocker link 80 at a rocker pivot point $p_3$, and (ii) a rocker link 80 pivotally attached at a first end 80*a* to the frame 20 and pivotally attached at the second end 80*b* to the connector link 90 at the rocker pivot point $p_3$, wherein the crank arm 40 is pivotally attached at the second end 40*b* to the connector link 90 at a crank pivot point $p_4$ which is positioned intermediate the first end foot link pivot point $p_1$ and the rocker pivot point $p_3$.

Figure 6:
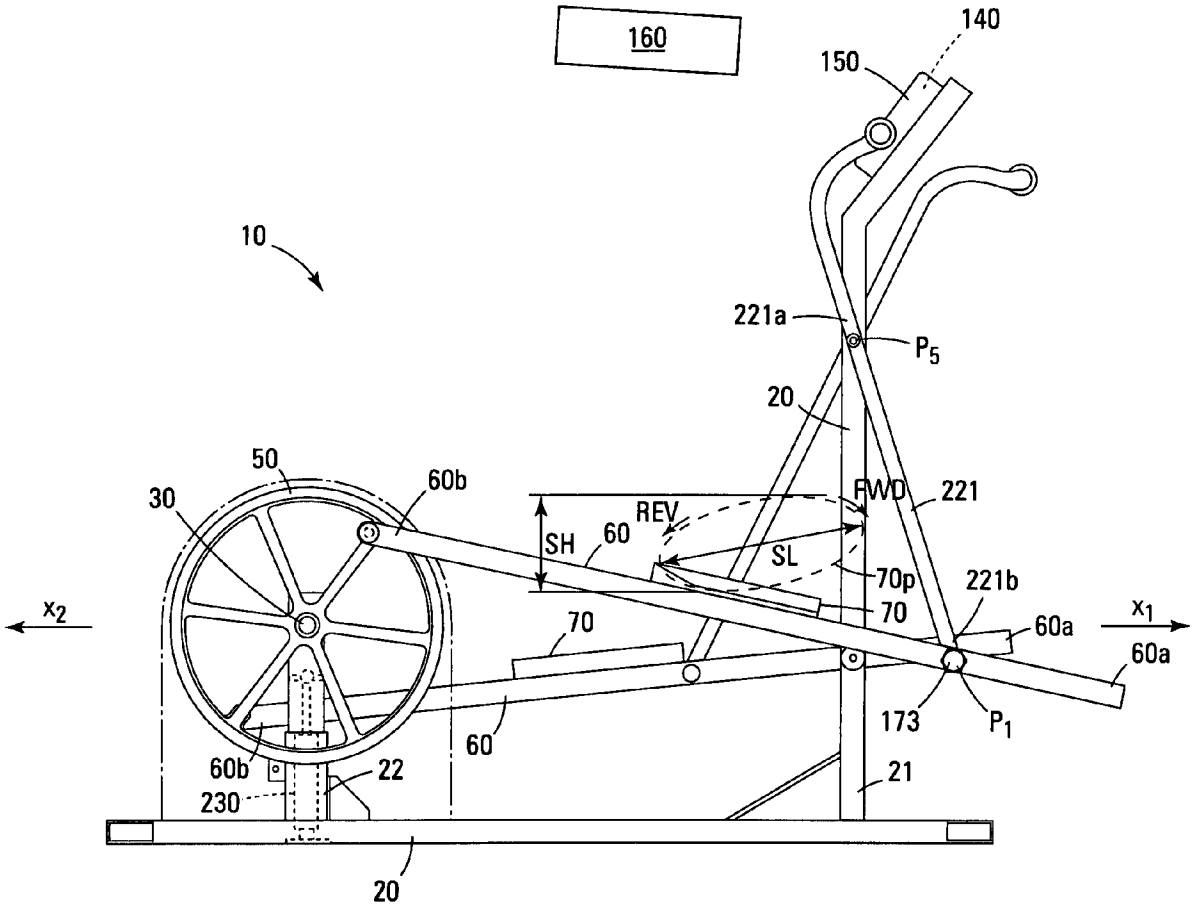
FIG. 6 is a side view of a second embodiment of the invention with protective housing removed and depicting a single foot link and associated components.
Figure 7:
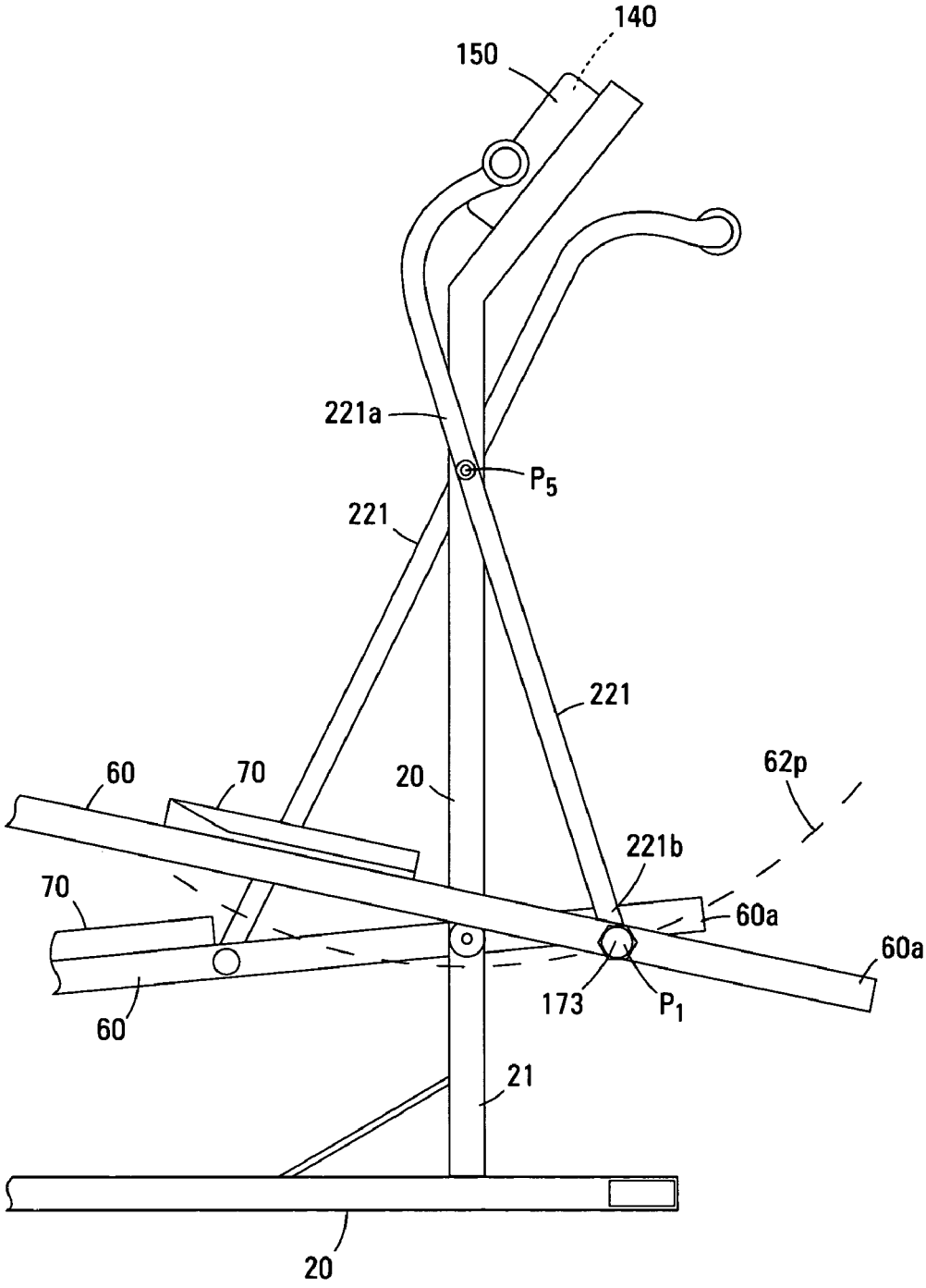
FIG. 7 is an enlarged view of the forward portion of the invention shown in FIG. 6 depicting the first end portion of the foot link and associated dynamic components.
Figure 8:
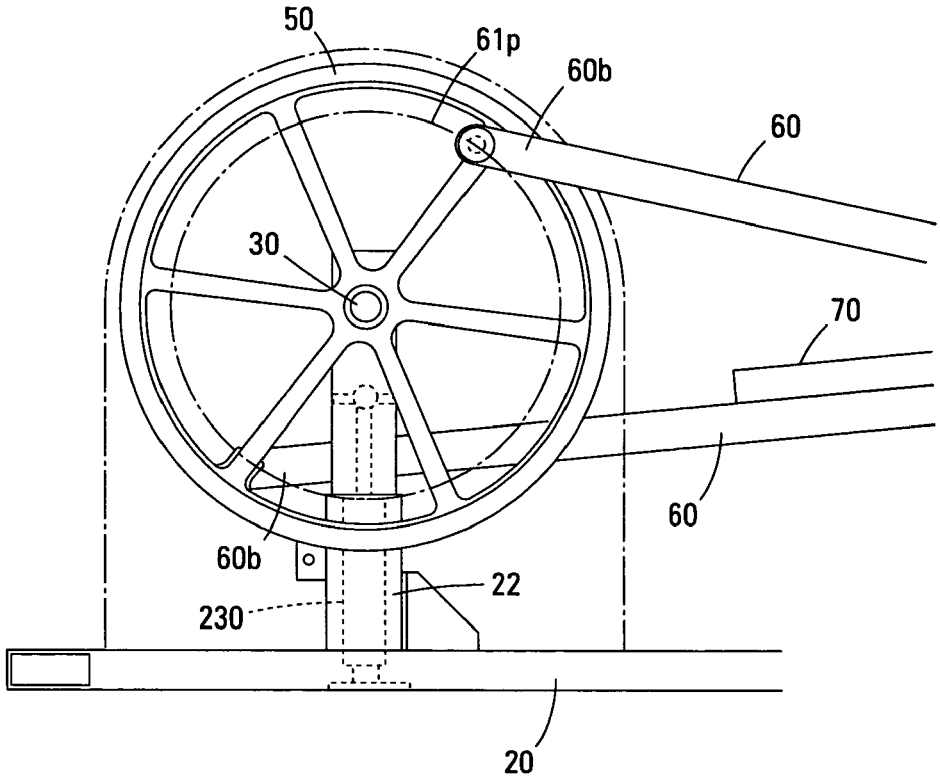
FIG. 8 is an enlarged view of the rearward portion of the invention shown in FIG. 6 depicting the second end portion of the foot link and associated supporting components.

A second specific embodiment of a structure for operably interconnecting the first and second foot links 60 with the frame 20 is shown in FIGS. 6-8. This embodiment has (i) a first end portion 60*a* of each foot link 60 pivotally attached proximate the second end 221*b* of a front guide arm 221, and pivotally attached proximate a first end 221*a* to the frame 20 at a front guide arm pivot point $p_5$ located above the foot link 60, for reciprocating travel of the first end portion 60*a* of the foot link 60 along a lateral path 62*p* and (iii) a second end portion 60*b* of each foot link 60 directly pivotally attached to a drive pulley 50 at a point (not numbered) spaced from the transverse axis z for travel along a closed loop path 61*p* about the transverse axis z.

Figure 9:
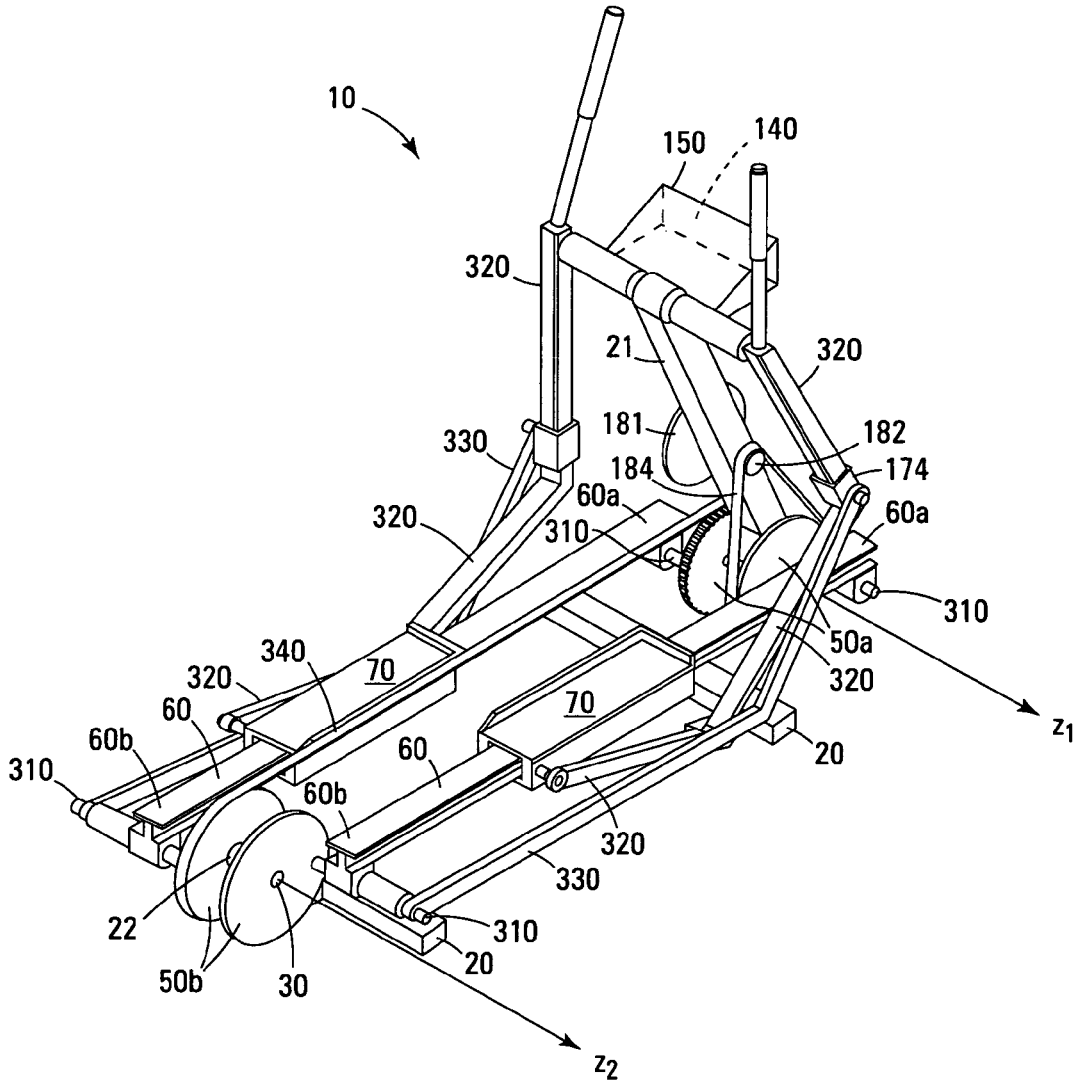
FIG. 9 is a perspective view of a third embodiment of the invention with the protective housing removed to facilitate viewing of other components.
Figure 10:
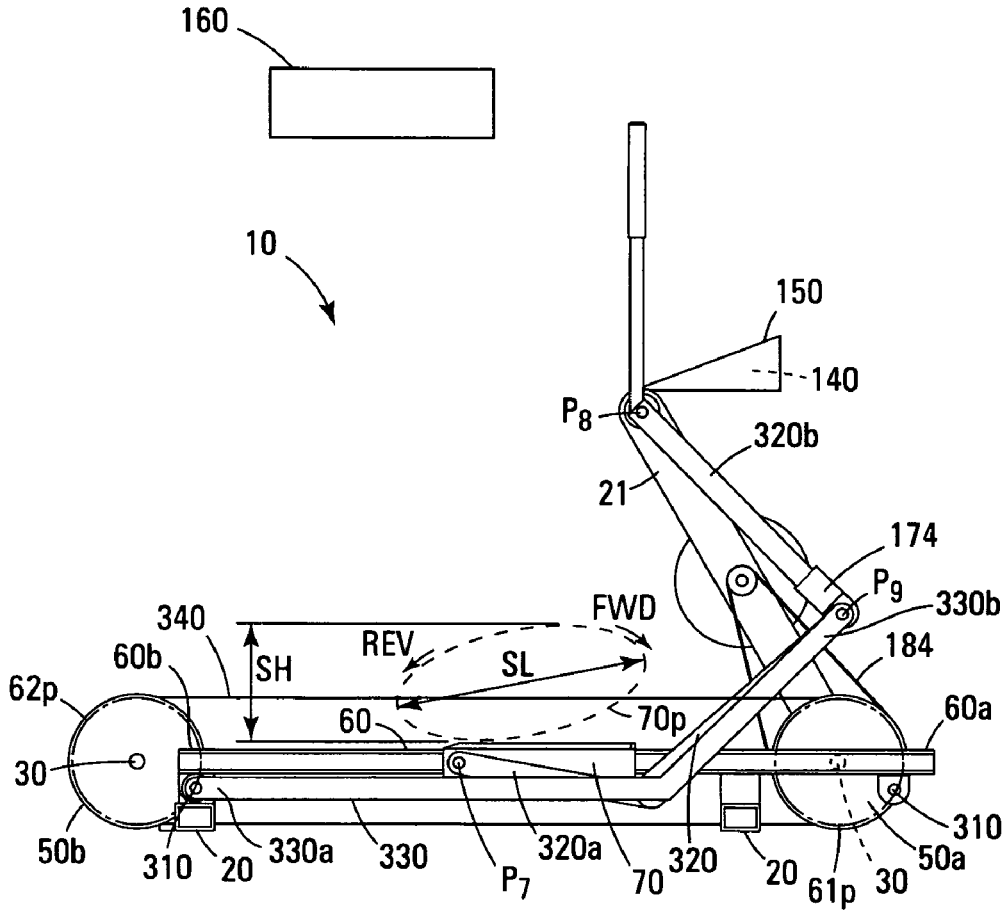
FIG. 10 is a side view of the invention shown in FIG. 9 with the protective housing removed and depicting a single foot link and associated components.
Figure 11:
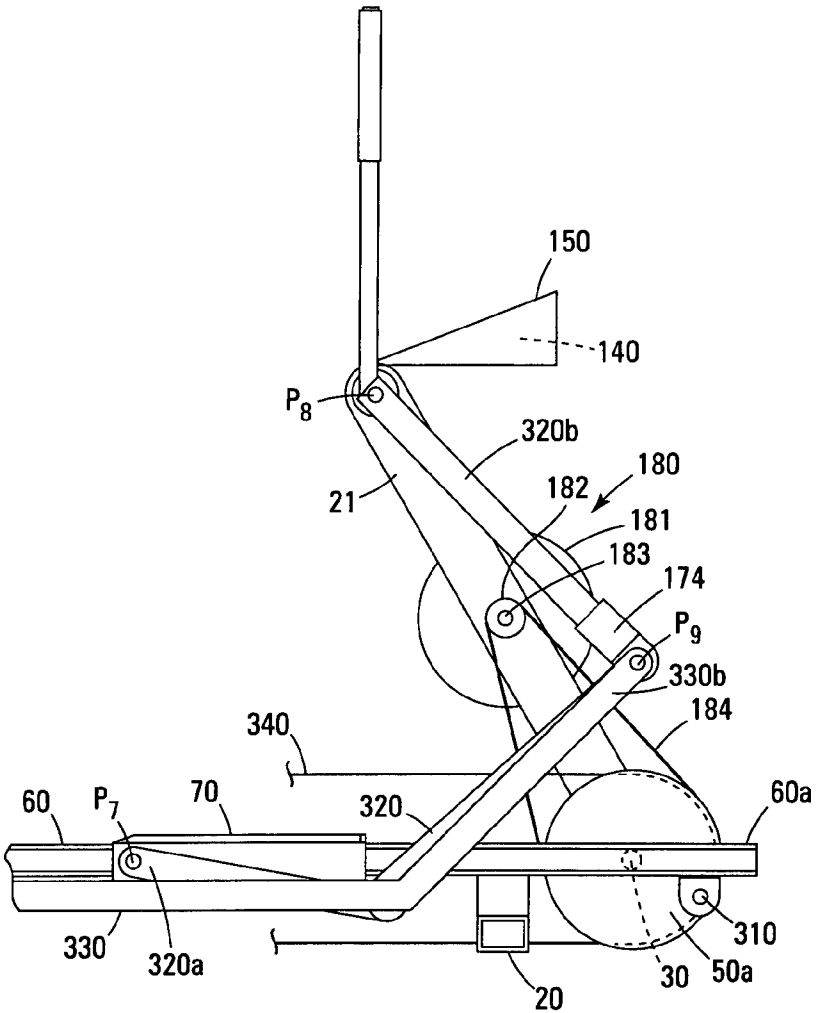
FIG. 11 is an enlarged view of the forward portion of the invention shown in FIG. 10 depicting the first end portion of the foot link and associated dynamic components.

A third specific embodiment of a structure for operably interconnecting the first and second foot links 60 with the frame 20 is shown in FIGS. 9-11. This embodiment is shown and described in detail in United States Patent Application Publication No. 2002/0055420, the disclosure of which is hereby incorporated by reference. Briefly, this embodiment has (i) a first end portion 60*a* of each foot link 60 pivotally supported upon a support shaft 310 which is attached to a front drive pulley 50*a* at a point (not numbered) spaced from a first transverse axis $z_1$ for travel along a first closed loop path 61*p* about the first transverse axis $z_1$, and (ii) a second end portion 60*b* of each foot link 60 pivotally supported upon a support shaft 310 which is attached to a rear drive pulley 50*b* at a point (not numbered) spaced from a second transverse axis $z_2$ for travel along a closed loop path 62*p* about the second transverse axis $z_2$. The front drive pulley 50*a* and rear drive pulley 50*b* are interconnected by a timing belt 340. A foot support 70 is slidably supported upon each foot link 60 and operably engaged by a rocker link 320 for effecting a reciprocating motion of the foot support 70 along the length of the foot link 60. Each rocker link 320 has a first end portion 320*a* pivotally connected to a respective foot support 70 at pivot point $p_7$ and a second end portion 320*b* pivotally mounted on the frame 20 at pivot point $p_8$ Movement of each rocker link 320 is controlled by a drawbar 330. Each drawbar 330 has a first end portion 330*a* constrained to travel in association with the respective foot link 60 relative to the first and second closed loop paths 61*p* and 62*p* and a second end portion 330*b* connected to a respective rocker link 320. The combination of a rocker link 320 and associated drawbar 330 cooperate to transfer and link travel of the foot link 60 along the first and second closed loop paths 61*p* and 62*p* to longitudinal sliding of the respective foot support 70 along the respective foot link 60.

The exercise device 10 preferably include a system attached to the frame 20 and in communication with the system through which the foot supports 70 are operably associated with the frame 20, such as a brake 100 and braking control system 110, for exerting a controlled variable resistive force against movement of the foot supports 70 along the closed loop path of travel 70*p*. It is preferred to provide a separate resistance device for each foot support 70. Many types of resistance devices are known such as pivoting devices, sliding devices, weights on cables or levers, braking motors, generators, brushless generators, eddy current systems, magnetic systems, alternators, tightenable belts, friction rollers, etc., any of which could be effectively utilized in the present invention. Exemplary resistance devices suitable for use in this invention include those disclosed in U.S. Pat. Nos. 5,423,729 issued to Eschenbach, 5,685,804 issued to Whan-Tong et al., 5,788,610 issued to Eschenbach, 5,836,854 issued to Kuo, 5,836,855 issued to Eschenbach, 5,846,166 issued to Kuo, 5,895,339 issued to Maresh, 5,947,872 issued to Eschenbach, 5,957,814 issued to Eschenbach, 6,042,512 issued to Eschenbach, 6,053,847 issued to Stearns et al., 6,090,013 issued to Eschenbach, 6,146,313 issued to Whan-Tong et al., 6,217,485 issued to Maresh, 6,409,632 issued to Eschenbach, 6,482,130 issued to Pasero et al., 6,544,146 issued to Stearns et al., 6,575,877 issued to Rufino et al., and 6,612,969 issued to Eschenbach, which disclosures are hereby incorporated by reference.

The exercise device 10 also preferably includes an inertia generation system 180 attached to the frame 20 and in communication with the system through which the foot supports 70 are operably associated with the frame 20. Such inertia generation system 180 are widely known and commonly utilized on stationary exercise equipment. An exemplary inertia generation system 180 is disclosed in United States Patent Application Publication No. 2002/0055420, the disclosure of which is hereby incorporated by reference. This system is shown in FIGS. 9-11. Briefly, the system 180 includes a flywheel 181 and a relatively smaller diameter pulley 182 are rotatably mounted on opposite sides (unnumbered) of the front stanchion 21. The flywheel 181 is keyed to the small pulley 182 by a central shaft 183. A belt 184 is looped about the front drive pulley 50*a* and the small pulley 182 to effect rotation of the small pulley 182 when the front drive pulley 50*a* is rotated by operation of the foot links 60. As a result, the flywheel 181 rotates at a relatively faster speed than the front drive pulley 50*a* and adds inertia to the linkage assemblies.

The heart rate monitor 160 senses the heart rate of a person A exercising on the exercise device 10. Suitable heart rate monitors 160 are well known to those skilled in the art. The heart rate monitor 160 communicates sensed heart rate data to the master control unit 140.

Adjustment of stride height SH and/or stride length SL may be accomplished in various ways. Two preferred methods, which may be employed individually or in combination, are (i) adjusting the angle of incline of the guide rail 120, and (ii) adjusting the position of one or more of the pivot points (not collectively referenced) about which an arm or link (not collectively referenced) pivots as the foot supports 70 travel along the closed loop path of travel 70*p*.

A wide variety of systems effective for adjusting the angle of incline of the guide rail 120 are known to those skilled in the art. Exemplary systems suitable for use in this invention are disclosed in U.S. Pat. Nos. Des. 372,282 issued to Passero et al., Des. 388,847 issued to Whan-Tong et al., 5,685,804 issued to Whan-Tong et al., 5,803,871 issued to Stearns et al., 5,836,854 issued to Kuo, 5,836,855 issued to Eschenbach, 5,848,954 issued to Stearns et al., 5,857,941 issued to Maresh et al., 5,882,281 issued to Stearns et al., 5,882,281 issued to Stearns et al., 5,893,820 issued to Maresh et al., 5,938,568 issued to Maresh et al., 5,957,814 issued to Eschenbach, 5,993,359 issued to Eschenbach, 5,997,445 issued to Maresh et al., 6,042,512 issued to Eschenbach, 6,063,009 issued to Stearns et al., 6,090,014 issued to Eschenbach, 6,126,574 issued to Stearns et al., 6,146,313 issued to Whan-Tong et al., 6,168,552 issued to Eschenbach, 6,171,215 issued to Stearns et al., 6,210,305 issued to Eschenbach, 6,254,514 issued to Maresh et al., 6,277,054 issued to Kuo, 6,302,825 issued to Stearns et al., 6,334,836 issued to Segasby, 6,340,340 issued to Stearns et al., 6,422,977 issued to Eschenbach, 6,440,042 issued to Eschenbach, 6,450,925 issued to Kuo, 6,454,682 issued to Kuo, 6,554,750 issued to Stearns et al., 6,612,969 issued to Eschenbach, 6,629,909 issued to Stearns et al., and United States Patent Application Publication Nos. 2002/0019298 filed by Eschenbach, and 2002/0142890 filed by Ohrt et al, which disclosures are hereby incorporated by reference.

A wide variety of systems effective for adjusting the position of one or more of the pivot points about which an arm or link pivots as the foot supports 70 travel along the closed loop path of travel 70*p* are known to those skilled in the art. Exemplary systems suitable for use in this invention are disclosed in U.S. Pat. Nos. 5,562,574 issued to Miller, 5,788,610 issued to Eschenbach, 5,836,854 issued to Kuo, 5,836,855 issued to Eschenbach, 5,882,281 issued to Stearns et al., 5,893,820 issued to Maresh et al., 5,895,339 issued to Maresh, 5,919,118 issued to Stearns et al., 5,921,894 issued to Eschenbach, 5,957,814 issued to Eschenbach, 5,993,359 issued to Eschenbach, 6,027,430 issued to Stearns et al., 6,027,431 issued to Stearns et al., 6,030,320 issued to Stearns et al., 6,045,488 issued to Eschenbach, 6,053,847 issued to Stearns et al., 6,077,196 issued to Eschenbach, 6,077,197 issued to Stearns et al., 6,077,198 issued to Eschenbach, 6,080,086 issued to Stearns et al., 6,090,013 issued to Eschenbach, 6,113,518 issued to Maresh et al., 6,135,923 issued to Stearns et al., 6,171,215 issued to Stearns et al., 6,196,948 issued to Stearns et al., 6,217,485 issued to Maresh, 6,248,044 issued to Stearns et al., 6,248,045 issued to Stearns et al., 6,248,046 issued to Maresh et al., 6,254,514 issued to Maresh et al., 6,277,054 issued to Kuo, 6,283,895 issued to Stearns et al., 6,334,836 issued to Segasby, 6,338,698 issued to Stearns et al., 6,361,476 issued to Eschenbach, 6,387,017 issued to Maresh, 6,390,953 issued to Maresh et al., 6,416,442 issued to Stearns et al., 6,440,042 issued to Eschenbach, 6,450,925 issued to Kuo, 6,547,701 issued to Eschenbach, 6,554,750 issued to Stearns et al., 6,565,486 issued to Stearns et al., 6,579,210 issued to Stearns et al., 6,612,969 issued to Eschenbach, 6,629,909 issued to Stearns et al., and United States Patent Application Publication Nos. 2001/0051562 filed by Stearns et al., 2002/0019298 filed by Eschenbach, 2002/0055420 filed by Stearns et al., and 2002/0142890 filed by Ohrt et al., which disclosures are hereby incorporated by reference.

Other systems for adjusting stride height SH and/or stride length SL which may be utilized include specifically, but not exclusively, (a) adjusting the position of the foot supports 70 along the length of the foot links 60, such as shown and described in U.S. Pat. No. 6,171,217 issued to Cutler, the disclosure of which is hereby incorporated by reference (b) adjusting the position of the roller 69 along the length of the foot link 60, and (c) adjusting the lateral x and/or longitudinal y position of the drive shaft 30, such as shown and described in U.S. Pat. No. 6,146,313 issued to Whan-Tong et al., the disclosure of which is hereby incorporated by reference.

One specific embodiment of a system for adjusting stride height SH and stride length SL is shown in FIGS. 1-4. This embodiment includes a combination of (i) a first pivot point repositioning unit 171 in communication with the master control unit 140 and operably engaging the foot link 60 and the connector link 90 so as to define the first end foot link pivot point $p_1$ and permit repositioning of the first end foot link pivot point $p_1$ along the length of the foot link 60 and/or the connector link 90 based upon a control signal from the master control unit 140, and (ii) an incline adjustment system 130 in communication with the master control unit 140 and operably engaging the guide rail 120 for changing the angle of incline of the guide rail 120 based upon a control signal from the master control unit 140.

This embodiment of a system for adjusting stride height SH and stride length SL may also include (iii) a second pivot point repositioning unit (not shown) in communication with the master control unit 140 and operably engaging the rocker link 80 and the connector link 90 so as to define the rocker pivot point $p_3$ and permit repositioning of the rocker pivot point $p_3$ along the length of the rocker link 80 and/or the connector link 90 based upon a control signal from the master control unit 140, and (iv) a third pivot point repositioning unit (not shown) in communication with the master control unit 140 and operably engaging the crank arm 40 and the connector link 90 so as to define the crank pivot point $p_4$ and permit repositioning of the crank pivot point $p_4$ along the length of the crank arm 40 and/or the connector link 90 based upon a control signal from the master control unit 140.

The alternative embodiment for supporting the second end portion 60*b* of each foot link 60 to the frame 20 shown in FIG. 5 may include a pivot point repositioning unit 172 similar to the pivot point repositioning unit 171 shown in FIGS. 1-3 (shown in block format in FIG. 5) in communication with the master control unit 140 and operably engaging the second end portion 60*b* of the foot link 60 and the rear guide arm 121 so as to define the second end foot link pivot point $p_2$ and permit repositioning of the second end foot link pivot point $p_2$ along the length of the foot link 60 and/or the length of the rear guide arm 121 based upon a control signal from the master control unit 140.

Another specific embodiment of a system for adjusting stride height SH and stride length SL is shown in FIGS. 6-8. This embodiment includes a combination of (i) a pivot point repositioning unit 173 similar to the pivot point repositioning unit 171 shown in FIGS. 1-3 (shown in block format in FIGS. 6 and 7) in communication with the master control unit 140 and operably engaging the foot link 60 and the front guide arm 221 so as to define the first end foot link pivot point $p_1$ and permit repositioning of the first end foot link pivot point $p_1$ along the length of the foot link 60 and/or the length of the front guide arm 221 based upon a control signal from the master control unit 140, and (ii) a linear actuator 230 in communication with the master control unit 140 with a first end of the actuator 230 attached to a fixed position portion of the frame 20 and a second end the actuator 230 attached to vertically adjustable portion of the frame 20 upon which the drive shaft 30 is rotatably mounted, for permitting longitudinal y repositioning of the drive shaft 30 relative to the fixed position portion of the frame 20 based upon a control signal from the master control unit 140.

Yet another specific embodiment of a system for adjusting stride height SH and stride length SL is shown in FIGS. 9-11. This embodiment includes a pivot point repositioning unit 174 similar to the pivot point repositioning unit 171 shown in FIGS. 1-3 (shown in block format in FIGS. 9 and 10) in communication with the master control unit 140 and operably engaging the rocker link 320 and the first end 330*a* of the drawbar 330 so as to define a drawbar-rocker pivot point $p_9$ and permit repositioning of the first end 330*a* of the drawbar 330 along the length of the rocker link 320 based upon a control signal from the master control unit 140.

A master control unit 140 communicates with (i) the incline adjustment system 130, (ii) the heart rate monitor 160, (iii) the pivot point repositioning unit 171 and (iv) the linear actuator 230. The master control unit 140 receives signals from the heart rate monitor 160, processes those signals to determine the heart rate of the person A exercising on the exercise device 10, and adjusts the stride length SL and/or stride height SH of the closed loop path 70*p* traveled by the foot supports 70 according to a preprogrammed adjustment in incline and/or pivot point locations based upon the sensed heart rate.

The master control unit 140 is also in communication with a user interface panel 150 as is typical for stationary exercise equipment.

I claim:

1. An exercise device comprising (a) a frame defining a transverse axis, (b) first and second foot supports operably associated with the frame for traveling along a closed loop path relative to the transverse axis wherein the closed loop path defines a stride length, (c) a heart rate monitor, (d) a means for automatically adjusting the stride length of the closed loop path traveled by the foot supports based upon a heart rate sensed by the heart rate monitor, (e) a guide arm pivotally attached to the frame, (f) a transversely extending drive shaft rotatably attached to the frame and extending along the transverse axis, (g) an extension element extending away from the transverse axis and fixedly attached to the drive shaft for unitary rotation with the drive shaft, and (h) first and second foot links each supporting a foot support and having (i) first and second ends, (ii) a first end portion pivotally attached to the extension element at a point spaced from the transverse axis for travel along a closed loop path relative to the transverse axis, and (iii) a second end portion pivotally supported by the guide arm for longitudinal travel of the second end portion of the foot link along an arcuate reciprocating path.

2. The exercise device of claim 1 wherein the closed loop path is an elliptical path.

3. The exercise device of claim 1 wherein the extension element is a drive pulley.

4. The exercise device of claim 1 wherein the extension element is a crank shaft.

5. The exercise device of claim 1 wherein the first end portion of each foot link is directly pivotally attached to the extension element.

6. The exercise device of claim 1 wherein the first end portion of each foot link is indirectly pivotally attached to the extension element.

7. The exercise device of claim 1 wherein the first end portion of each foot link is indirectly pivotally attached to the extension element via an intermediate linkage system wherein the intermediate linkage system is (i) pivotally attached at a proximal point to the foot link, (ii) pivotally attached at a distal point to the frame, and (iii) pivotally attached to the extension element intermediate the proximal and distal points of attachment.

8. The exercise device of claim 7 wherein the first end of each foot link travels along a non-circular arcuate path relative to the transverse axis.

9. An exercise device comprising (a) a frame defining a transverse axis, (b) first and second foot supports operably associated with the frame for traveling along a closed loop path relative to the transverse axis wherein the closed loop path defines a stride height, (c) a heart rate monitor, (d) a means for automatically adjusting the stride height of the closed loop path traveled by the foot supports based upon a heart rate sensed by the heart rate monitor, (e) a guide arm pivotally attached to the frame, (f) a transversely extending drive shaft rotatably attached to the frame and extending along the transverse axis, (g) an extension element extending away from the transverse axis and fixedly attached to the drive shaft for unitary rotation with the drive shaft, and (h) first and second foot links each supporting a foot support and having (i) first and second ends, (ii) a first end portion pivotally attached to the extension element at a point spaced from the transverse axis for travel along a closed loop path relative to the transverse axis, and (iii) a second end portion pivotally supported by the guide arm for longitudinal travel of the second end portion of the foot link along an arcuate reciprocating path.

10. The exercise device of claim 9 wherein the closed loop path is an elliptical path.

11. The exercise device of claim 9 wherein the means for automatically adjusting the stride height of the closed loop path traveled by the foot supports comprises a means for adjusting the distance between the point at which the guide arm is pivotally attached to the frame and the point at which the guide arm is pivotally attached to the second end portion of each foot link.

12. The exercise device of claim 9 wherein the extension element is a drive pulley.

13. The exercise device of claim 9 wherein the extension element is a crank shaft.

14. The exercise device of claim 9 wherein the first end portion of each foot link is directly pivotally attached to the extension element.

15. The exercise device of claim 9 wherein the first end portion of each foot link is indirectly pivotally attached to the extension element.

16. The exercise device of claim 9 wherein the first end portion of each foot link is indirectly pivotally attached to the extension element via an intermediate linkage system wherein the intermediate linkage system is (i) pivotally attached at a proximal point to the foot link, (ii) pivotally attached at a distal point to the frame, and (iii) pivotally attached to the extension element intermediate the proximal and distal points of attachment.

17. The exercise device of claim 16 wherein the first end of each foot link travels along a non-circular arcuate path relative to the transverse axis.

18. An exercise device comprising (a) a frame defining a transverse axis, (b) first and second foot supports operably associated with the frame for traveling along a closed loop path relative to the transverse axis wherein the closed loop path defines a stride length and a stride height, (c) a heart rate monitor, (d) a means for automatically adjusting the stride length and stride height of the closed loop path traveled by the foot supports based upon a heart rate sensed by the heart rate monitor, (e) a guide arm pivotally attached to the frame (f) a transversely extending drive shaft rotatable attached to the frame and extending along the transverse axis, (g) an extension element extending away from the transverse axis and fixedly attached to the drive shaft for unitary rotation with the drive shaft, and (h) first and second foot links each supporting a foot support and having (i) first and second ends (ii) a first end portion pivotally attached to the extension element at a point spaced from the transverse axis for travel along a closed loop path relative to the transverse axis, and (iii) a second end portion pivotally supported by the guide arm for longitudinal travel of the second end portion of the foot link along an arcuate reciprocating path.

19. The exercise device of claim 18 wherein the closed loop path is an elliptical path.

20. The exercise device of claim 18 wherein the means for automatically adjusting the stride length and stride height of the closed loop path traveled by the foot supports comprises a means for adjusting the distance between the point at which the guide arm is pivotally attached to the frame and the point at which the guide arm is pivotally attached to the second end portion of each foot link.

21. The exercise device of claim 18 wherein the first end portion of each foot link is indirectly pivotally attached to the extension element via an intermediate linkage system wherein the intermediate linkage system is (i) pivotally attached at a proximal point to the foot link, (ii) pivotally attached at a distal point to the frame, and (iii) pivotally attached to the extension element intermediate the proximal and distal points of attachment.

22. The exercise device of claim 21 wherein the first end of each foot link travels along a non-circular arcuate path relative to the transverse axis.

* * * * *

UNITED STATES PATENT AND TRADEMARK OFFICE

CERTIFICATE OF CORRECTION

PATENT NO. : 7,448,986 B1
APPLICATION NO. : 10/781038
DATED : November 11, 2008
INVENTOR(S) : Timothy J. Porth It is certified that error appears in the above-identified patent and that said Letters Patent is hereby corrected as shown below:

| Column | Line | |
|---|---|---|
| 12 | 9 | "rotatable" should be --rotatably-- |

Signed and Sealed this

Thirtieth Day of June, 2009

JOHN DOLL
*Acting Director of the United States Patent and Trademark Office*